US007806725B1

(12) United States Patent
Chen

(10) Patent No.: US 7,806,725 B1
(45) Date of Patent: Oct. 5, 2010

(54) TOOL-FREE COAXIAL CONNECTOR

(75) Inventor: Yi-Hsiang Chen, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 12/385,907

(22) Filed: Apr. 23, 2009

(51) Int. Cl.
*H01R 9/05* (2006.01)

(52) U.S. Cl. ..... 439/578

(58) Field of Classification Search ..... 439/578
See application file for complete search history.

(56) References Cited

U.S. PATENT DOCUMENTS 5,002,503 A * 3/1991 Campbell et al. ..... 439/578
6,217,383 B1 * 4/2001 Holland et al. ..... 439/578
6,558,194 B2 * 5/2003 Montena ..... 439/585
6,648,683 B2 * 11/2003 Youtsey ..... 439/578
7,063,565 B2 * 6/2006 Ward ..... 439/578

* cited by examiner

*Primary Examiner*—Truc T Nguyen
(74) *Attorney, Agent, or Firm*—Rosenberg, Klein & Lee

(57) ABSTRACT

A tool-free coaxial connector includes an outer sleeve, an inner sleeve coaxial with the outer sleeve, and an annular tooth provided around an inner wall surface of the inner sleeve. The inner sleeve can receive a central conductor and an insulating spacer of the coaxial cable therein, and the outer sleeve can receive a braided metal sheath and an insulating sheath of the coaxial cable therein. When a stripped free end of the coaxial cable is inserted into the coaxial connector, the inner sleeve is forced into between the insulating spacer and the braided metal sheath, and the annular tooth is tightly engaged with the insulating spacer; and when the coaxial cable is rearward pulled, the inner sleeve is rearward moved from a first to a second position and the insulating sheath of the coaxial cable is pressed against an annular rib in the outer sleeve.

3 Claims, 3 Drawing Sheets

TOOL-FREE COAXIAL CONNECTOR

FIELD OF THE INVENTION

The present invention relates to a tool-free coaxial connector that can be installed on a free end of a coaxial cable without the need of using any tool.

BACKGROUND OF THE INVENTION

A coaxial connector is well-known in the technological field of coaxial cable transmission. Typically, an F-type coaxial connector is screwed to a mating interface connector, so that a coaxial cable connected to the F-type coaxial connector can be electrically connected to various kinds of electronic devices, such as a television set, a CB (citizen's band) radio, an FM (frequency modulation) radio, and other amateur wireless systems.

FIG. 1 is a sectional view of an F-type coaxial connector 10, being illustrated as a representative example of the conventional coaxial connectors. The F-type coaxial connector 10 includes a collar 11, a cylindrical member 12 coaxially fitted in the collar 11, and a nut-shaped connecting ring 13 rotatably mounted to and end of the cylindrical member 12. A free end of a coaxial cable 14 can be inserted into the coaxial connector 10, such that an insulating spacer and a central conductor of the coaxial cable 14 are received in the cylindrical member 12, and a braided metal sheath and an insulating sheath of the coaxial cable 14 are located between an outer surface of the cylindrical member 12 and an inner surface of the collar 11. A hexagonal compression tool is used to apply a compression force on the collar 11, so that the collar 11 has a hexagonally shaped outer surface and tightly clamps to the insulating sheath of the coaxial cable 14.

The above-described manner of assembling the F-type coaxial connector 10 to the coaxial cable 14 is disadvantageous because a hexagonal compression tool is required to compress the collar 11 in order to connect the coaxial connector 10 to the free end of the coaxial cable 14. Therefore, the assembling cost is increased and an operator has to inconveniently carry different tools along with him.

Therefore, it is desirable to develop a tool-free coaxial connector that can be conveniently and quickly connected to a free end of a coaxial cable without the need of using any tool.

SUMMARY OF THE INVENTION

A primary object of the present invention is to provide a tool-free coaxial connector that can be installed on a free end of a coaxial cable without the need of using any tool, so as to improve the conventional coaxial connector that must be tightened to the coaxial cable using a tool.

To achieve the above and other objects, the tool-free coaxial connector for installing on a coaxial cable without the need of using any tool according to the present invention includes an outer sleeve, an inner sleeve being coaxially disposed in the outer sleeve and rearward movable from a first position to a second position in the outer sleeve, and an annular tooth provided around an inner wall surface of the inner sleeve. The inner sleeve can receive a central conductor and an insulating spacer of the coaxial cable therein, and the outer sleeve can receive a braided metal sheath and an insulating sheath of the coaxial cable therein. When a stripped free end of the coaxial cable is inserted into the coaxial connector, the inner sleeve is forced into between the insulating spacer and the braided metal sheath, and the annular tooth is tightly engaged with the insulating spacer; and when the coaxial cable is rearward pulled, the inner sleeve is simultaneously rearward moved from the first position to the second position to achieve a required interface size.

The outer sleeve is provided on an inner wall surface adjacent to a rear open end thereof with a radially inward annular rib. When the inner sleeve is moved to the second position, the insulating sheath of the coaxial cable is tightly pressed against the annular rib, allowing the coaxial cable to firmly associate with the outer sleeve.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
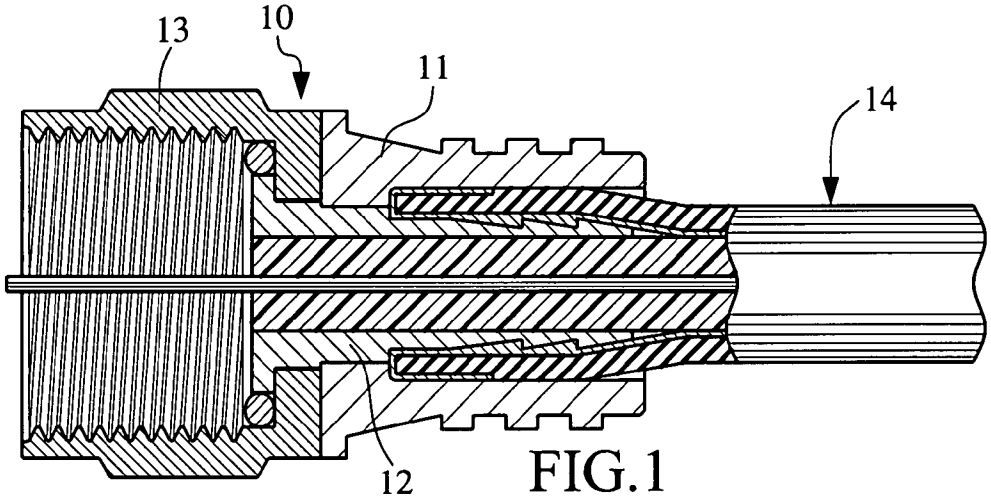
FIG.1 PRIOR ART
FIG. 1 is a sectional view of a conventional coaxial connector with a coaxial cable connected thereto.
Figure 3:
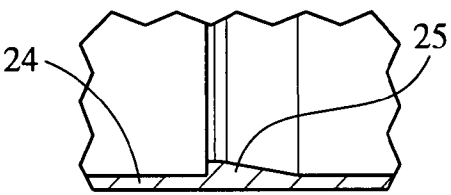
FIG. 3 is an enlarged view of the circled area 3 in FIG. 2.
Figure 2:
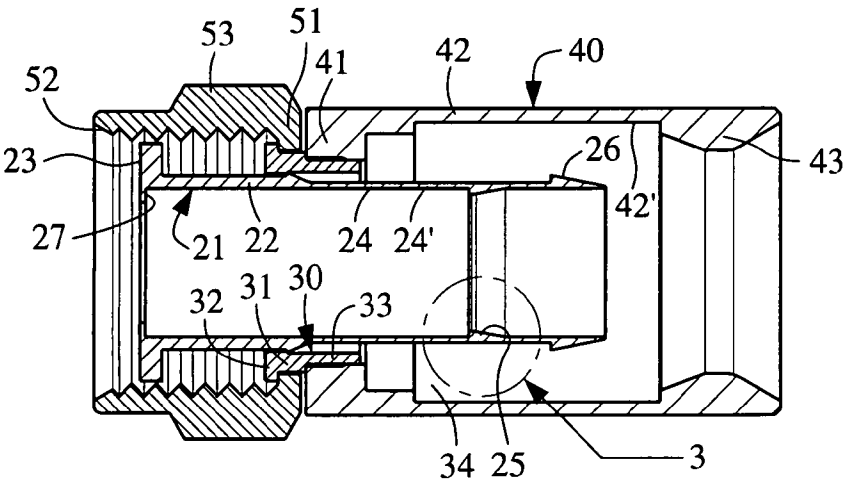
FIG. 2 is a sectional view of a tool-free coaxial connector according to a preferred embodiment of the present invention.

Please refer to FIGS. 2 and 3. A tool-free coaxial connector according to a preferred embodiment of the present invention is generally denoted by reference numeral 20, and includes an inner sleeve 21, a collar 30, an outer sleeve 40, and a connecting ring 50.

The inner sleeve 21 includes a main portion 22, a radially outward flange 23 formed around a front end of the main portion 22, and an extended portion 24 extending from a rear end of the main portion 22. The extended portion 24 has an inner diameter the same as the main portion 22, but an outer diameter and a wall thickness smaller than that of the main portion 22. An annular tooth 25 is formed around an inner wall surface 24' of the extended portion 24 of the inner sleeve 21, such that points of the tooth 25 are directed toward a front end of the coaxial connector 20. An outer wall surface around a rear open end of the extended portion 24 is formed into a circle of radially raised and rearward declined slope 26.

The collar 30 includes a main portion 31, a radially outward flange 32 formed around a front end of the main portion 31, and an extended portion 33 extending from a rear end of the main portion 31. The extended portion 33 has an inner diameter the same as the main portion 31 but an outer diameter and wall thickness smaller than that of the main portion 31. The extended portion 33 of the collar 30 is concentrically located around the extended portion 24 of the inner sleeve 21 with a space left between them. And, the inner sleeve 21 is axially movable located in the collar 30.

The outer sleeve 40 includes a main portion 41 mounted around the extended portion 33 of the collar 30, and an extended portion 42 rearward extending from the main portion 41. The extended portion 42 has an outer diameter the same as the main portion 41 but a wall thickness smaller than that of the main portion 41, and has a smooth outer wall surface. The extended portion 42 of the outer sleeve 40 is concentrically located around the extended portion 24 of the inner sleeve 21 with an annular hollow space 34 left between them. A radially inward annular rib or protrusion 43 is formed around an inner wall surface 42' of the extended portion 42 adjacent to a rear open end thereof.

The connecting ring 50 is located at a front end of the coaxial connector 20, and can be used in differently configured connecting interfaces, such as F, BNC, RCA, and IEC connectors. In the illustrated embodiment, the connecting ring 50 is used in an F connector. The connecting ring 50 includes a radially inward flange 51, which is located between the outward flange 32 of the collar 30 and the main portion 41 of the outer sleeve 40, such that the connecting ring 50 is freely rotatable between the collar 30 and the outer sleeve 40. The connecting ring 50 has an inner wall surface provided with screw threads 52 and a smooth hexagonally shaped outer wall surface 53. The coaxial connector 20 can be screwed to a corresponding connecting interface on an electronic device by turning the connecting ring 50 at the hexagonal outer wall surface 53 with a wrench or other suitable tool, so that a coaxial cable connected to the coaxial connector 20 is mechanically and electrically connected to the electronic device.

Figure 4A:
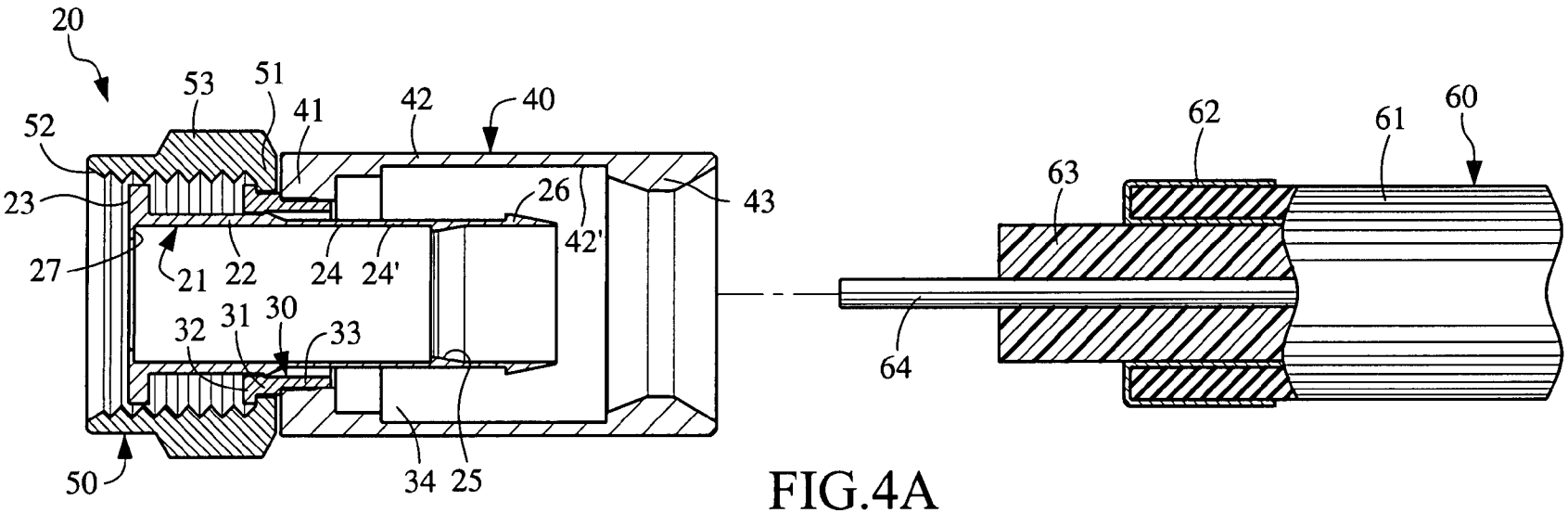
FIGS. 4A to 4C illustrate the manner of installing the tool-free coaxial connector of the present invention on a coaxial cable.
Figure 4B:
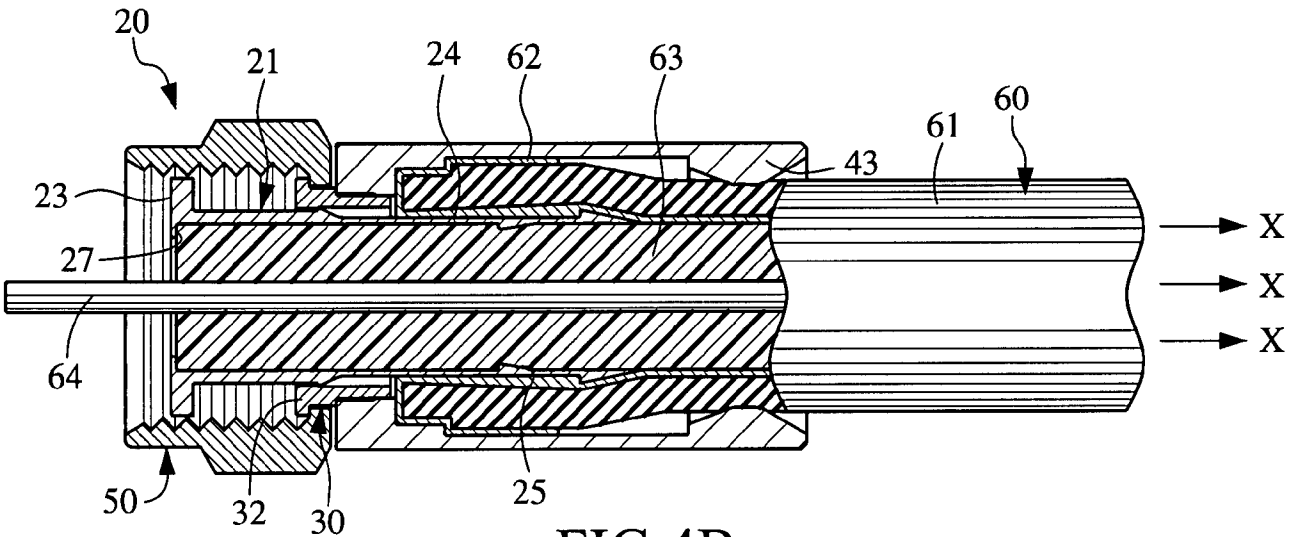
Figure 4C:
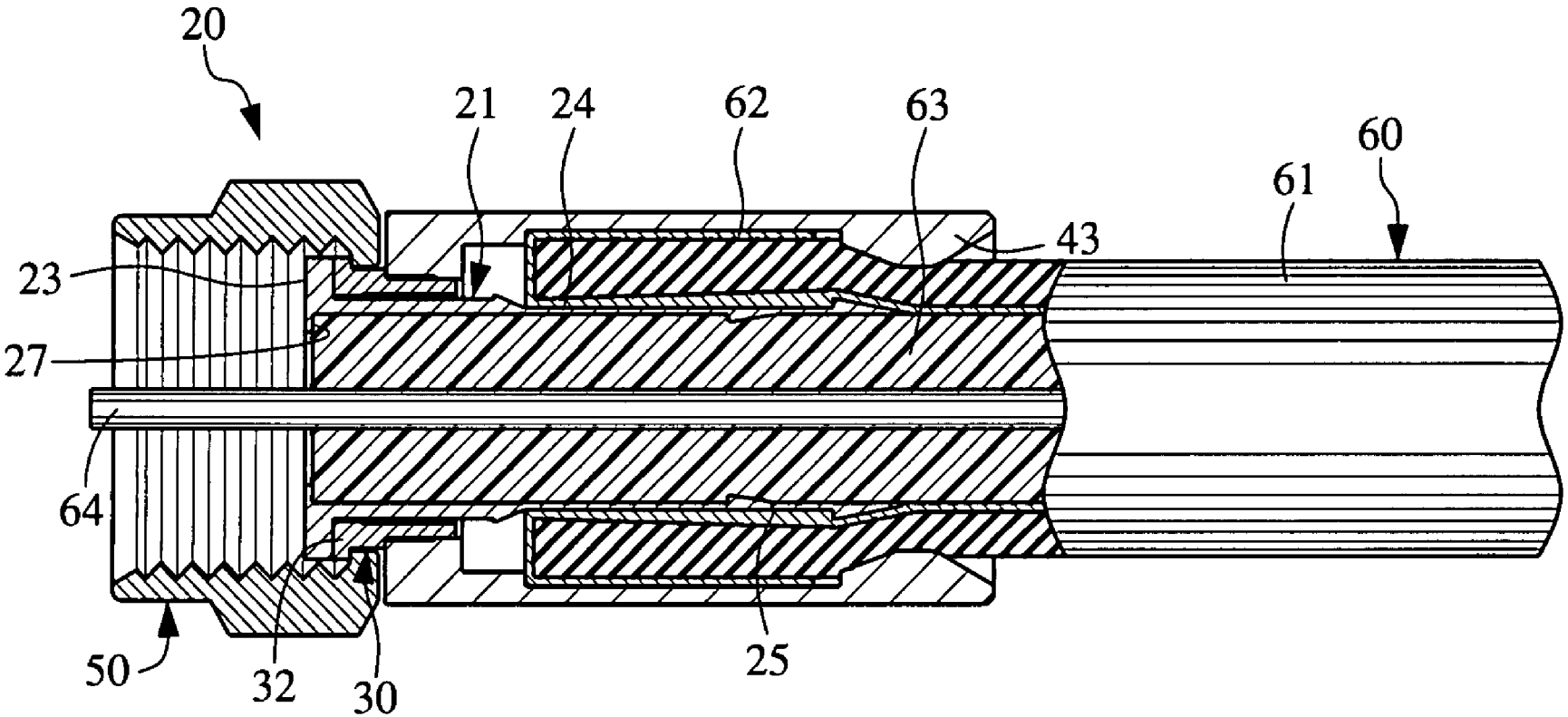

FIGS. 4A to 4C show the manner of installing the coaxial connector 20 on a coaxial cable 60 without using any tool. The coaxial cable 60 includes, from outer to inner side, an insulating sheath 61, a braided metal sheath 62, an insulating spacer 63, and a central conductor 64. Please refer to FIG. 4A. Before installing the coaxial connector 20, first strip a length of the insulating sheath 61 from a free end of the coaxial cable 60, and turn part of the exposed braided metal sheath 62 backward to expose a length of the insulating spacer 63 and the central conductor 64. Meanwhile, the inner sleeve 21 of the coaxial connector 20 before installing is located at a first position closer to a front end of the connecting ring 50. Then, as shown in FIG. 4B, the stripped free end of the coaxial cable 60 as prepared in FIG. 4A is inserted into the inner sleeve 21 to contact a front end of the insulating spacer 63 with a flat inner end surface 27 of the front end of the inner sleeve 21. While inserting the coaxial cable 60 into the inner sleeve 21, the extended portion 24 of the inner sleeve 21 is forced into between the braided metal sheath 62 and the insulating spacer 63 of the coaxial cable 60. As a result, the annular tooth 25 is forced against an outer circumferential surface of the insulating spacer 63 to tightly engage with the insulating spacer 63, bringing the inner sleeve 21 to firmly mechanically connect to the coaxial cable 60, so that the free end of the coaxial cable 60 is held in the coaxial connector 20.

Then, a force in the direction as indicated by the arrows X in FIG. 4B is applied to the coaxial cable 60, so that the coaxial cable 60 is moved into a final connected position in the coaxial connector 20, as shown in FIG. 4C. When pulling the coaxial cable 60 as shown in FIG. 4B, the inner sleeve 21 is simultaneously moved backward from the first position closer to the front open end of the connecting ring 50 to a second position, at which the outward flange 23 of the inner sleeve 21 is abutted on the outward flange 32 of the collar 30. With the inner sleeve 21 located at the second position, a required connecting interface size can be met, and the insulating sheath 61 of the coaxial cable 60 is in direct and tight contact with the annular rib 43.

Therefore, with the above arrangements, the tool-free coaxial connector of the present invention can be installed on a coaxial cable without using any tool, and the annular tooth and the annular rib provided in the inner sleeve and the outer sleeve, respectively, provide sufficient strength to associate the inner sleeve and the outer sleeve with the insulating spacer and the insulating sheath of the coaxial cable, respectively, ensuring the tool-free coaxial connector of the present invention is firmly connected to the coaxial cable.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A tool-free coaxial connector for installing on a coaxial cable without the need of using any tool and allowing the coaxial cable to mechanically and electrically connect to a corresponding connector on an electronic device, the coaxial cable including a central conductor, a insulating spacer surrounding the central conductor, at least one layer of braided metal sheath surrounding the insulating spacer, and an insulating sheath surrounding the braided metal sheath; the coaxial connector comprising:

an inner sleeve having an outward flange on an end section and an outer sleeve coaxially located around the inner sleeve with an annular hollow space left between the inner and the outer sleeve; the inner sleeve being adapted to receive the central conductor and the insulating spacer of the coaxial cable therein, the outer sleeve being adapted to receive the braided metal sheath and the insulating sheath therein, and the inner sleeve being rearward movable from a first position to a second position in the outer sleeve;

an annular tooth being provided around an inner wall surface of the inner sleeve at a predetermined position thereof; and a collar located between the inner sleeve and the outer sleeve adaptable to abut said outer flange of inner sleeve when said coaxial cable is displaced in a rearward direction;

whereby when installing the coaxial connector on the coaxial cable by inserting a stripped free end of the coaxial cable into the coaxial connector via a rear open end of the outer sleeve, the inner sleeve is forced between the insulating spacer and the braided metal sheath, and the annular tooth around the inner wall surface of the inner sleeve is tightly engaged with the insulating spacer; and when the coaxial cable is rearwardly displaced, the inner sleeve is simultaneously rearward displaced from the first position to the second position where said outward flange of the inner sleeve abuts an outward flange of the collar, thereby terminating the rearward movement of the inner sleeve.

2. The tool-free coaxial connector as claimed in claim 1, wherein the inner sleeve is axially movable in the collar.

3. The tool-free coaxial connector as claimed in claim 1, wherein the outer sleeve is provided on an inner wall surface adjacent to the rear open end with a radially inward annular rib, whereby when the inner sleeve is moved to the second position, the annular rib and the insulating sheath of the coaxial cable are forced to tightly press against and accordingly associate with each other.

* * * * *